United States Patent [19]

Antonelli

[11] 4,089,353

[45] May 16, 1978

[54] FILLING VALVE FOR CARBONATED LIQUID BOTTLING MACHINES

[75] Inventor: Mario Eduardo Antonelli, Buenos Aires, Argentina

[73] Assignee: Crown Cork & Seal Company, Inc., Philadelphia, Pa.

[21] Appl. No.: 732,049

[22] Filed: Oct. 13, 1976

Related U.S. Application Data

[63] Continuation of Ser. No. 583,652, Jun. 4, 1975, abandoned.

[51] Int. Cl.[2] ..... B65B 3/04; B67C 3/04

[52] U.S. Cl. ..... 141/302

[58] Field of Search ..... 141/6, 37, 39, 4, 5, 141/7, 8, 46–64, 285–306, 144–152, 183–191, 250–284, 392

[56] References Cited

U.S. PATENT DOCUMENTS

| | | | |
|---|---|---|---|
| 3,032,077 | 5/1962 | Plock et al. | 141/39 |
| 3,779,293 | 12/1973 | Kaiser | 141/39 |

*Primary Examiner*—Houston S. Bell

*Attorney, Agent, or Firm*—Woodcock, Washburn, Kurtz & Mackiewicz

[57] ABSTRACT

Filling apparatus comprising a filling valve which controls the flow of a carbonated liquid from a reservoir to a container. The filling valve includes a tube which extends from the reservoir to the container for equalizing the pressure in the container as the container is filled. When the liquid in the container reaches a predetermined level, venting by the tube automatically ceases. A valve control automatically closes the valve in response to the reduced flow into the container as the pressure builds up within. The initial opening of the valve to permit the flow of liquid into the container and initial opening of the pressure communicating tube is controlled by the two different cams of the actuating mechanism.

10 Claims, 8 Drawing Figures

INOPERATIVE

PRESSURIZE

ADMIT LIQUID

AUTOMATIC SHUTOFF

FILLING VALVE FOR CARBONATED LIQUID BOTTLING MACHINES

This is a continuation, of application Ser. No. 583,652, filed June 4, 1975, now abandoned.

FIELD OF THE INVENTION

The present invention relates to a method and apparatus for filling containers with a gasified liquid and more particularly to a method and apparatus for increasing the filling rate of the container, providing a "quiet" filling and controlling the fill level of the liquid introduced in the container.

PRIOR ART

In the filling of containers with effervescent or carbonated liquids, as for example non-alcoholic beverages and beer, it has been the practice to first place the empty container under the effect of a slightly lower, equal or slightly higher pressure than the one at which the effervescent liquid is made to flow into the container. This stage is designated in the art as the "counterpressure stage". Once the container has been placed under the effects of a counterpressure, the effervescent liquid is made to flow into the container while the gas contained in the container is discharged therefrom. Common practice has consisted in returning the gas to the filling machine reservoir containing the effervescent liquid under an overlying body of gas having a predetermined pressure.

The difficulty encountered in the prior art involves making sure that total counterpressure in the bottle is achieved before starting discharge of the liquid; otherwise, if counterpressure has been only partially effected, the effervescent liquid will be introduced turbulently into the container, a stirring or disturbance occurring therein which will cause foaming of the liquid and resulting in insufficiently filled containers. These problems are made worse with the increase in filling rates brought about by the need of having faster filling machines.

In recent years, the fill level of a container being filled with a carbonated liquid has been controlled by the position of ports in a gas return tube. In such counter pressure filling arrangements, when the effervescent liquid reaches an appropriate height the return tube port is covered by the liquid. At this point, the return of gas into the filling machine reservoir stops. Since there is no outlet for the air being displaced by the filling liquid, as more liquid enters the bottle the air above the liquid is compressed between the surface of the liquid and the filling head. At some point the pressure of the air in the bottle offsets not only the pressure of the filling machine reservoir, but also the weight of the column of liquid above the bottle.

Conventionally in such systems the liquid flowing into the bottle passes through a multiplicity of small orifices, such as those in a mesh or screen. When the pressure in the bottle equals that in the reservoir the phenomenon of capillarity or surface tension comes into play, and prevents further liquid from flowing through the mesh. Accordingly, the mesh presents a barrier to the effervescent liquid and prevents further inflow to the bottle after the bottle and reservoir pressures have become equal.

A problem which has arisen with the above-described prior art systems is that as the rate of filling the bottles increases the inertia of the liquid increases correspondingly. The use of a retaining mesh and dependence upon the surface tension effect for suddenly stopping fluid flow has proven unsatisfactory. As the liquid is not stopped at the regular, desired level an excessively high fill level often occurs.

Since defectively filled containers, either by shortage or excess, must be rejected, and content of such containers cannot be recovered, losses on account of such defectively filled containers can become quite substantial over a given period of time.

OBJECTS OF THE INVENTION

An important object of the present invention is to provide a method whereby the filling cycle of effervescent liquids in a filling machine is improved, said method allowing a shorter filling cycle, so that the output capacity of the filling machine is increased.

A further object and advantage of the present invention is to provide an improved filling head having an efficient fill level control which reduces the possibility of producing excessively filled containers.

The above and other objects and advantages will be more clearly shown in the following description of the operation, in the attached claims and in the accompanying drawings.

In accordance with these and other objects, a preferred embodiment of the invention comprises a reservoir for carbonated liquid, valve means for controlling the flow of the carbonated liquid from the reservoir to a container and pressure communicating means between the container and the source of the carbonated liquid. The pressure communicating means automatically closes when the liquid reaches a predetermined height in the container so as to diminish the flow of the liquid through the valve means. The valve control means is responsive to the rate of flow through the valve means for automatically closing the valve means when the rate of flow has diminished to a predetermined rate.

In order that the present invention may be more readily understood, the description of a preferred embodiment is given hereinbelow, with illustrative and in no way limitative purposes, reference being made to the accompanying drawings.

DESCRIPTION OF A PREFERRED EMBODIMENT

Figure 1:
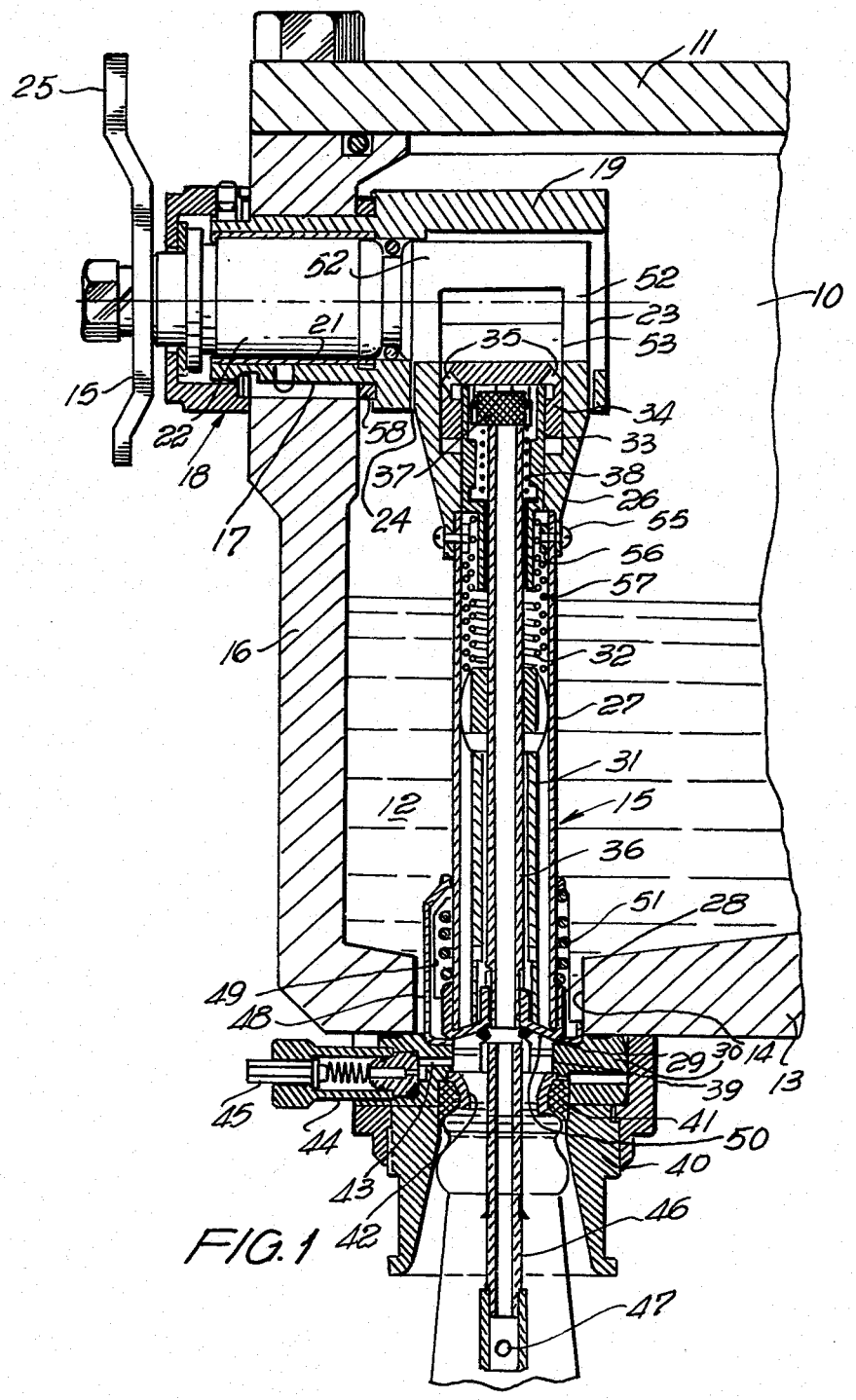
FIG. 1 is a longitudinal section view of the valve of the present invention in the closed position thereof.
Figure 2:
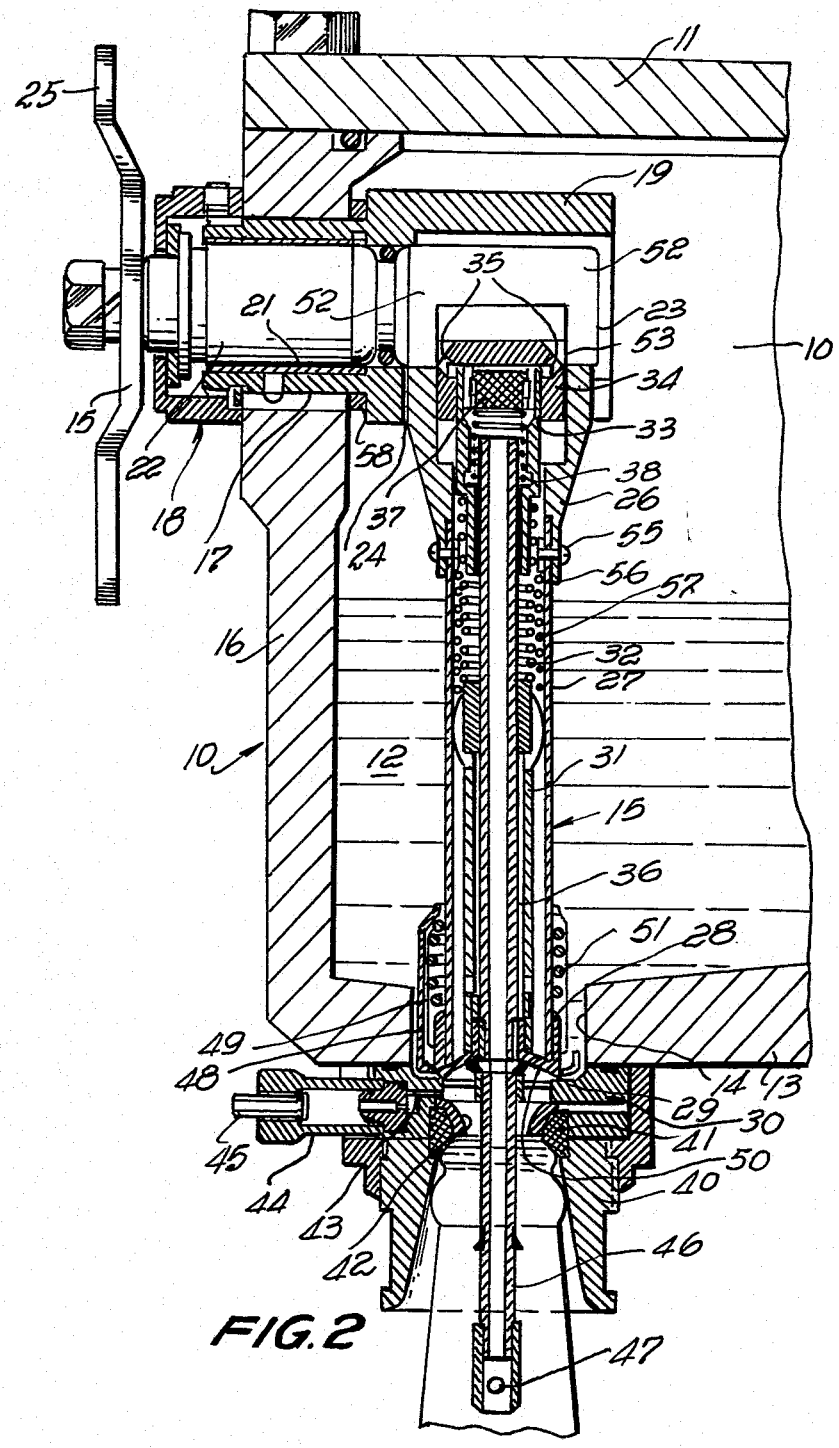
FIG. 2 is a section view similar to FIG. 1, showing the valve in a partially open position to equalize pressures.

Essentially, the present invention comprises a valve 15 housed in a reservoir 10 having at the top a tight closing cover 11 and containing the carbonated liquid 12 with which bottles or containers are to be filled.

Said reservoir 10 is provided at the bottom 13 with a plurality of openings 14 through which the heads of filling valves 15 pass. Aligned with said openings 14 but located in side wall 16 of reservoir 10 openings 17 are provided, through which control means 18 of filling valve 15 pass.

Said control means 18 include a body 19 passing through said openings 17 having sealing means 58 attached thereto by suitable elements.

Body 19 is provided with a central passage 21 through which a shaft 22 controlling a cam mechanism 23 passes, said central passage 21 having a lateral opening 24 opposite said cam mechanism.

In the portion projecting from side wall 16 of reservoir 10, shaft 22 is provided with a lever 25 controlling movement of said shaft.

Lateral opening 24 houses the upper end of filling valve 15, which comprises a head 26 preferably of a cylindrical and substantially hollow shape and extending into a pressure communicating tube 27, and the bottom end whereof is received in a first movable valve comprising a closing gasket 28 seating on a valve seat 29 of body 30 attached beneath opening 14 to bottom 13 of reservoir 10.

Inside tube 27 a support 31 is housed, on the upper part whereof the lower end of a spring 32 and 57 rest. The top end of spring 32 carries a casing 33 which is attached by its upper part to cap 34 having ports 35 communicating between the inside of head 26 and the inside of casing 33.

Within casing 33, a tubular conduit 36 is received, extending along and coaxially with valve 15, passing through flexible closing gasket 28 and down to body 30.

The upper end of tubular conduit 36 terminates in the inside of casing 33 and is closed by seal 37 seating thereon, said seal 37 being arranged between said end of tubular conduit 36 and inside upper face of cap 34, a compression spring 38 being provided which urges said seal 37 to unseat from its seat stop tubular conduit 36.

Body 30 which is attached to bottom 13 of reservoir 10 has a plurality (not shown) of discharge openings 39 aligned with bores 14 but having a lesser diameter, the upper part of which constitutes the seat 29 upon which closing gasket 28 bears. Said body 30 has a lower member 40 attached to it to serve as a guide for centering the bottle top rim against sealing ring 41, arranged beneath discharge openings 39 and over which funnel 42 is disposed.

In the cylindrical wall of one of discharge openings 39, particularly the one on the side of reservoir side wall 16, a discharge port 43 is provided communicating with a vacuum relief valve 44 having an actuating nose 45 projecting therefrom. Completing the subassembly, a ventilation tube 46 having two ports 47 close to its lower end is integral and in communication with tubular conduit 36, extending downwardly beyond the lower end of lower member 40 through discharge openings 39.

Surrounding closing gasket 28 a second movable valve member comprising a bell-shaped intermediate member 48 having an opening 49 is disposed; the lower end turned-in lip of bell 48 underlies conical bottom face 50 of gasket 28 and is urged thereagainst by compression spring 51, the lower end of which bears against gasket 28, the upper end of spring 51 bearing against the inside upper edge of bell 48.

OPERATION

Figures 5A, 5B, 5C, 5D:
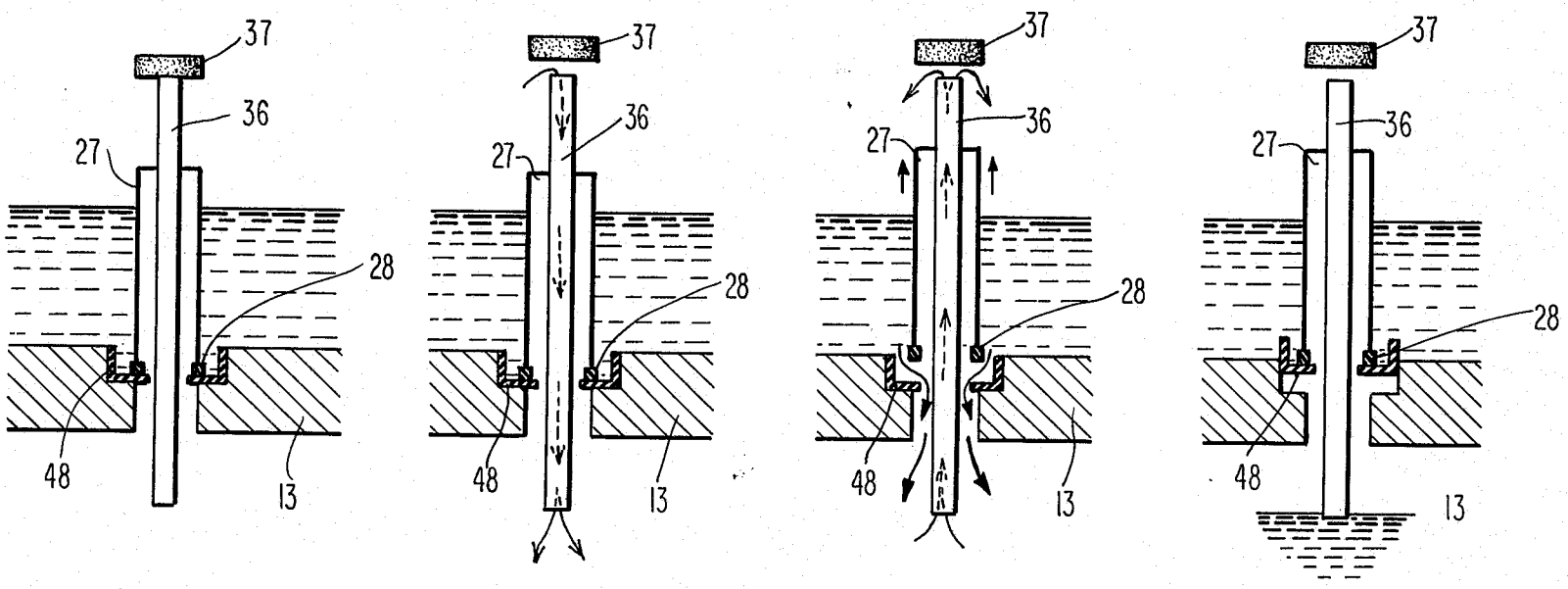

FIG. 5 illustrates the operation of the invention in schematic form. In FIG. 5*a* the system is inoperative, and it is assumed that no container is yet in place. A fluid pressure $P_f$ is built up within the upper reservoir while the container pressure $P_c$ is assumed to be atmospheric pressure. Seal 37 is positioned tightly over the top of tubular conduit 36, so that the pressurized gas within the reservoir cannot flow through the conduit. In like manner pressure communicating tube 27 (which is in gas-tight relationship with inner conduit 36) is in a downward position so that the gasket 28 at the lower end of the tube is forced tightly against intermediate member 48. Member 48 is in turn seated tightly in the reservoir bottom 13.

In FIG. 5*b* seal 37 is lifted from tubular conduit 36, allowing the pressure $P_f$ of the gas within the system reservoir to be expelled through conduit 36 and into a container (not shown) which is in air-tight sealing relationship with reservoir bottom 13. This action continues until an equilibrium is established wherein the container pressure $P_c$ is the same as reservoir pressure $P_f$.

At some subsequent time, and as illustrated in FIG. 5*c*, the outer pressure communication tube 27 is raised so that gasket 28 is lifted from member 48. At the same time seal 37 is maintained in spaced relationship from the top of tubular conduit 36. Fluid from the reservoir then flows downwardly between gasket 28 and member 48 into the container (not shown). Since the container is in sealing relationship with the bottom 13 of the reservoir the air or gas within the container is displaced by the inflowing liquid. The air or gas is forced upwardly through tubular conduit 36 and into the space above the fluid within the reservoir.

Operation as in FIG. 5*c* will continue until the pressure within the container exceeds that within the reservoir. As shown in FIG. 5*d*, the level of fluid within the container will ultimately rise to the lower end of tubular conduit 36. At this point, and as conventionally occurs in filling systems, the pressure within the container rises suddenly inasmuch as the gas or air within the container can no longer be displaced by the inflowing liquid. At this point member 48, which had previously been held against the bottom 13 of the reservoir by the pressure of the fluid within the reservoir, moves upwardly until it makes fluid-tight contact with gasket 28. This cuts off the inflow of fluid cleanly, without reliance upon capillarity or surface tension. Instead, two mating elements are caused to close tightly together, preventing any further flow of fluid as may occur when a mesh is used to restrain further fluid flow. A mechanical linkage (not shown) is then used to force pressure communicating tube 27 downwardly, urging member 48 to the bottom of its seat. The linkage further urges seal 37 tightly against the upper end of tubular conduit 36, as shown in FIG. 5*a*. The container may then be removed from the reservoir bottom and a new container brought into place so that the cycle may begin once more.

Reservoir 10 is loaded with pressure carbonated liquid 12, the valve being in the position shown in FIG. 1. The bottle to be filled is raised by a conventional mechanism (not shown) to bear against sealing ring 41, ventilation tube 46 being received in the bottle within the area known as bottle neck, the bottle being centered by lower member 40.

Figures 3, 4:
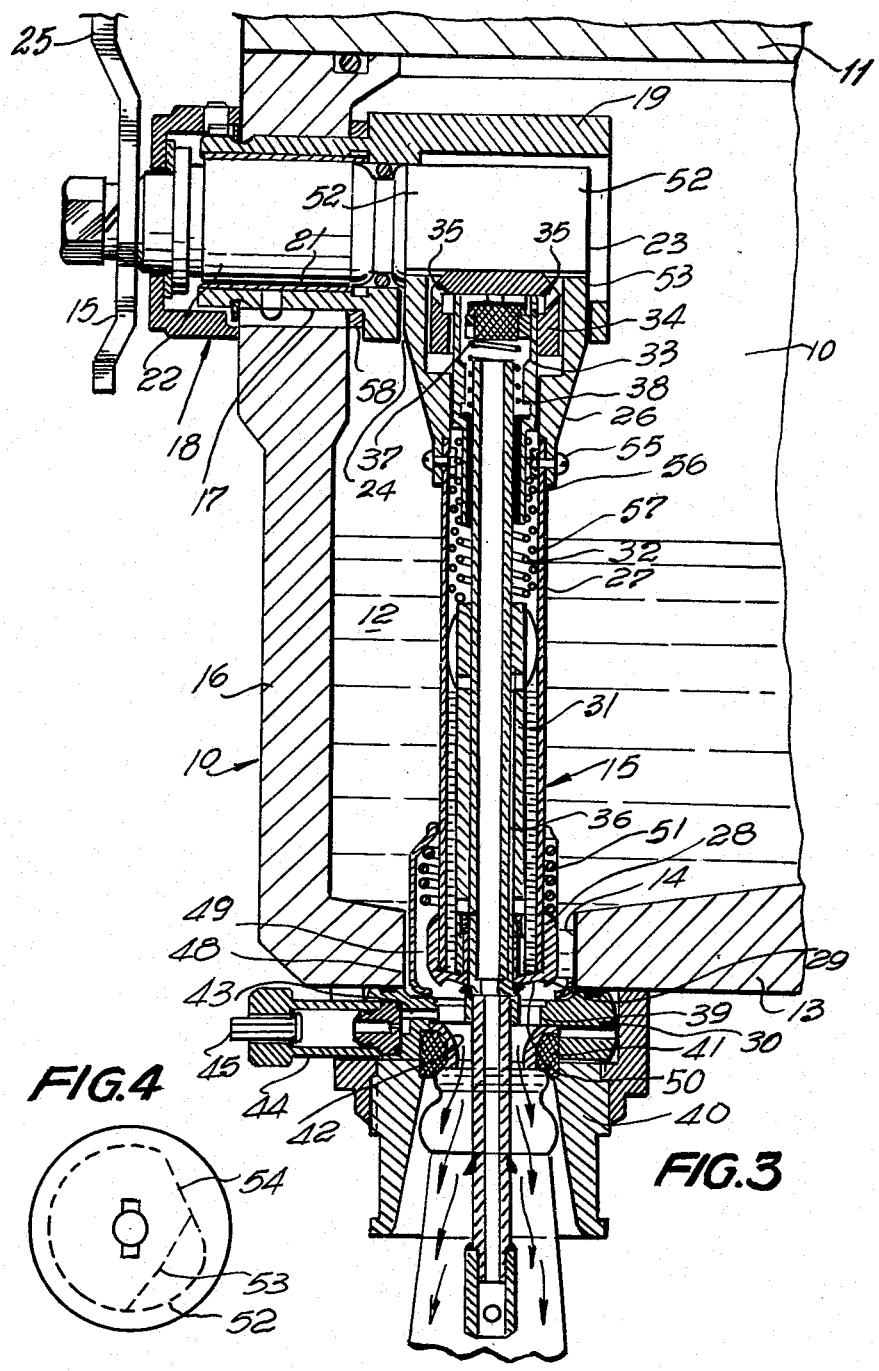
FIG. 3 is a section view similar to FIG. 1, showing the valve in its fully opened position for passage of liquid into the bottle.
FIG. 4 is a schematic view showing the cam arrangement and FIGS. 5*a*–5*d* are schematic drawings illustrating the operation of the present invention.

Once the bottle has been properly located in said position by means of conventional mechanisms, lever 25 of control means 18 is actuated, thus causing rotation of shaft 22 and consequently of cam mechanism 23. Thus outer cam 52, which bears on head 26, by the intermediary of tube 27 maintains blocking gasket 28 on its seat, thus closing passage of liquid through discharge openings 39, but inner cam 53, having a lesser radius, as shown in FIG. 4 allows upward movement of cap 34 and casing 33, because of the action of spring 32, whereupon the whole moves upwards. By means of spring 38 bearing on an inside shoulder in a casing 33, seal 37 is lifted from counterpressure tubular conduit 36, whereby pressurized gas inside the reservoir passes through ports 35 into casing 33 and then into counterpressure tube 36. The bottle is then filled with pressurized gas so as to balance pressures inside the bottle and inside the reservoir.

After this, and once sufficient time for reaching balance of pressures has passed, the machine control mechanism again actuates lever 25 causing shaft 22 to rotate so that cam mechanism 23, through intermediate radius cams 54, releases head 26, which through the action of spring 57 is raised and causes opening of the valve; that is, unseating of gasket 28 from seat 29. The action of the weight of the liquid column on bell 48, by overcoming the force of spring 51, allows passage of liquid between said bell and gasket 28 whereupon filling is achieved through discharge openings 39 and funnel 42. In turn, the proper cam mechanism forces cap 34 to move downwards approaching seal 37 to the end of counterpressure tube 36 but without closing it. If as from this instant the bottle were to burst, seal 37 which was only being held by spring 38, due to gas pressure will seat on the upper end of counterpressure tube 36 closing it due to the absence of an opposing pressure, thus preventing discharge of pressurized gas from reservoir 10.

When level of the beverage in the bottle covers ports 47 in ventilation tube 46 and return of gas into the reservoir ceases, the increase in the level of liquid in the bottle causes a counterpressure balancing the pressure in the reservoir and the weight of the column of liquid that the beverage therein represents.

Upon decrease, due to this effect, of the rate of the stream of liquid which served to maintain bell 48 spaced from closing gasket 28, said bell 48 through the action of spring 51 is urged against gasket 28 thus causing quick closing of the beverage passage, because the opening between wall 14 and the outer wall of bell 48 is close enough for the liquid to be retained by effect of surface tension.

After this, the machine control mechanism again actuates lever 25 rotating it so that the shaft will place the cam mechanism 23 in such a manner to finally close the valve due to the action of the maximum radius cam 52 which will act on cap 34 forcing it to move downwards, also acting to lower seat 37, so that counterpressure tube 36, and the combination of tube 27 and closing gasket 28 will be closed.

The bottle thus isolated from the reservoir, the valve in its course will pass before a suitable device which will actuate nose 45 of vacuum relief valve 44, which by means of port 45 will allow pressure in the bottle to be discharged therethrough to atmosphere, so that the bottle will be ready for descent and subsequent operations elsewhere.

While the invention has been particularly shown and described with reference to a preferred embodiment, those skilled in the art will appreciate that changes in form and detail may be made therein without departing from the scope of the invention, as set forth in the attached claims.

I claim:

1. Filling apparatus for use in filling a container with a carbonated liquid comprising:

a reservoir for containing the carbonated liquid;

a gas valve including a gas filling member for extending into the container and below the level to be attained by liquid therein and a sealing member coupling said filling member to the interior of said reservoir;

means for periodically opening said gas valve to allow pressures in said reservoir and said container to equalize;

a liquid valve including a first member and a second member movable independently thereof to allow said first member to seat thereupon;

a valve seat in fluid communication with said reservoir and receiving said second member to prevent liquid outflow therebetween;

means for periodically moving said first member from a first position encapturing said second member against said valve seat, to a second position;

biasing means for biasedly disposing said second member in sealing relationship against said first member;

said second member comprising means disposed between said reservoir and the interior of the container and responsive to a difference in pressure between said liquid and said container interior to displace said second member away from said first member to allow a flow of liquid therebetween.

2. The apparatus of claim 1 wherein said valve seat is mounted in a stationary position at the periphery of an opening in said reservoir, said first member having said gas valve passing therethrough and through said opening to said reservoir, said second member being bell-shaped and surrounding said first movable member, said biasing means comprising a coiled spring coupled to said first member and said second member.

3. The apparatus of claim 1 including an actuating mechanism coupled to said gas valve means for controlling the communication through said filling member and said gas valve means.

4. The apparatus of claim 3 wherein said actuating means comprises two cam means, one of said cam means controlling communication through said gas valve, the other of said cam means controlling said liquid valve.

5. The apparatus of claim 4 wherein said two cam means comprise a cylindrical body having substantially identical cam surfaces at both ends thereof and an intermediate cam surface of lesser radius than said cam surfaces at said ends, said intermediate cam surface controlling said gas valve and said cam surfaces at said ends controlling said liquid valve means.

6. The apparatus of claim 5 wherein said gas valve means comprising a hollow body having an upper end in contact with said cam surfaces at said ends and said pressure filling member comprises a hollow tube extending through said first member and a sealing member located between the upper end of the hollow tube and said intermediate cam surface.

7. Filling apparatus for use in filling a container with a carbonated liquid comprising:

a reservoir for containing the carbonated liquid;

a gas valve including a gas filling member for extending from the interior of said reservoir into the container and below the level to be attained by the liquid therein;

means for periodically opening said gas valve to allow the pressures in said reservoir and in said container to equalize;

a liquid valve including a gasket member;

a valve seat disposed in fluid communication with said reservoir;

a second, intermediate member disposed between said valve seat and said gasket;

means for periodically moving said gasket from a first position encapturing said intermediate member against said valve seat to a second position in spaced relation above said valve seat;

biasing means for urging said intermediate member against said gasket, said biasing means exerting a force which may be overcome by fluid within said reservoir;

whereby fluid may flow between said gasket and said intermediate member and into said container, when reservoir pressure is no less than container pressure; and said intermediate member moves upwardly to meet said gasket and cut off liquid flow into said container in response to an increase in container pressure.

8. Apparatus according to claim 7, wherein said biasing means comprising a spring disposed between means carrying said gasket, and said intermediate member.

9. Apparatus according to claim 8, further including an actuating mechanism coupled to said gas valve means for controlling the communication through said filling member and said gas valve means, said actuating means comprising two cam means, one of said cam means controlling communication through said gas valve means, the other of said cam means controlling said liquid valve.

10. The apparatus of claim 9 wherein said gas valve means comprises a tubular conduit having an upper end extending into said reservoir and a lower end for extending into a container, and said liquid valve comprises a hollow tube coaxial with said gas valve means, said gasket means being disposed at the lowermost end of said hollow tube.

* * * * *